United States Patent [19]

Sirbola

[11] Patent Number: 4,720,329

[45] Date of Patent: Jan. 19, 1988

[54] APPARATUS AND METHOD FOR THE ELECTROLYTIC PLATING OF LAYERS ONTO COMPUTER MEMORY HARD DISCS

[75] Inventor: Michael A. Sirbola, League City, Tex.

[73] Assignee: Microsurface Technology Corp., Houston, Tex.

[21] Appl. No.: 806,081

[22] Filed: Dec. 6, 1985

Related U.S. Application Data

[63] Continuation-in-part of Ser. No. 651,493, Sep. 17, 1984, abandoned.

[51] Int. Cl.[4] ..... C25D 7/00; C25D 17/00

[52] U.S. Cl. ..... 204/23; 204/212; 204/218; 204/228; 360/135

[58] Field of Search ..... 204/23, 212, 5, 215, 204/216, 217, 218, 228; 360/135

[56] References Cited

U.S. PATENT DOCUMENTS

| | | | |
|---|---|---|---|
| 526,482 | 9/1894 | Bridgman | 204/212 |
| 1,029,965 | 6/1912 | Aylsworth | 204/5 X |
| 1,073,868 | 9/1913 | Perreur-Lloyd | 204/212 |
| 1,347,088 | 7/1920 | Greenawalt | 204/212 |
| 2,438,885 | 4/1948 | Bell | 204/212 |
| 2,675,348 | 4/1954 | Greenspan | 204/5 X |
| 3,236,757 | 2/1966 | Litt | 204/212 X |
| 3,470,082 | 9/1969 | Raymond et al. | 204/228 |
| 4,144,160 | 3/1979 | Faulkner | 204/212 |
| 4,359,375 | 11/1982 | Smith | 204/212 |

OTHER PUBLICATIONS

Dennis Waid et al., Min.-Micro Systems, pp. 237-242, May 1983.

N. Ibl, Surface Technol., 10, pp. 81-104, (1980).

J. Cl. Puippe et al., J. Appl. Electrochem., 10, pp. 775-784, (1980).

G. H. Cockett et al., J. Electrochem. Soc., pp. 906-908, vol. 108, No. 9, (1961).

Tu Chen et al., J. Appl. Phys., 49 (3), pp. 1816-1818, Mar. 1978.

R. J. von Gutfeld et al., Appl. Phys. Lett., 35 (9), pp. 651-653, Nov. 1979.

*Primary Examiner*—G. L. Kaplan

*Attorney, Agent, or Firm*—Dula, Shields & Egbert

[57] ABSTRACT

An apparatus for electrolytic plating of computer memory discs comprising a plating container, a spindle, a prime mover, an anode, and an electrical transmission system. The plating container contains a liquid plating bath having a nickel compound included therein. The spindle is rotatably mounted to the plating container. The spindle has a section for receiving the computer memory disc radially. The prime mover is connected to the spindle so as to apply rotational energy to the spindle. The anode is fastened to the plating container generally adjacent and in plane parallel to the disc. Another anode is placed on the opposite side of the disc. The electrical transmission system is connected to the disc about the spindle and to the anode.

21 Claims, 8 Drawing Figures

APPARATUS AND METHOD FOR THE ELECTROLYTIC PLATING OF LAYERS ONTO COMPUTER MEMORY HARD DISCS

RELATED APPLICATIONS

The present application is a continuation-in-part of U.S. patent application Ser. No. 651,493, filed Sept. 17, 1984, and now abandoned, entitled "A Method for the Electrolytic Plating of Various Metalic Layers Onto A Computer Memory Hard Disc Such That An Extremely Smooth Surface With Precisely Controlled Grain Structure Results."

FIELD OF THE INVENTION

This invention is directed to improvements in plating elements and associated apparatus and methods; more particularly, it is directed to methods and apparatus for the electroplating of thin metal layers onto the aluminum substrate of a computer disc.

BACKGROUND ART

In present-day data processing systems, it is the usual practice to employ magnetic memory discs for storing binary bits representing digital data. The memory discs usually comprise a magnetic disc which is scanned by a magnetic transducer head. The magnetic head is capable of inducing flux reversals in the magnetic domains of the disc and, in turn, of reading a pattern of magnetic orientations on the disc, and translating changes in the magnetic orientation into a series of digitally encoded binary bits.

Several types of magnetic head/magnetic memory disc interfaces are used in present-day data processing systems. For example, magnetic tape memories and floppy magnetic disc memories include magnetic heads which are in intimate contact with the magnetic memory. Another type of magnetic memory is known as the Winchester type which uses rigid magnetic discs. The Winchester magnetic disc memory provides maximum reliability and minimum error generation by eliminating physical contact between the magnetic head and the magnetic disc. This is achieved by means of a flying magnetic head which does not actually contact the surface of the magnetic disc.

It is evident that for maximum efficiency it is essential that the actual displacement of the head from the surface of the magnetic disc be kept at a minimum. Present-day systems are available in which the displacement is of the order of 10–14 microns. Accordingly, for satisfactory operation of the Winchester system it is essential that the surface of the magnetic disc be extremely flat and uniform.

The magnetic disc for the Winchester system is currently prepared from a slurry of gamma ferric oxide mixed in a matrix of an organic material capable of forming a thin uniform magnetic film. A rigid disc was used and the magnetic film deposited on the disc was burnished to provide the uniform surface characteristics required in that type of drive.

U.S. Pat. No. 3,634,047, issued to Faulkner, disclosed a method and apparatus for electroplating the magnetic film on the disc substrate so as to provide a magnetic memory disc suitable for use in the Winchester system. However, prior to the electroplating of the main magnetic film, practice is to provide a fine grain paramagnetic film. This is usually achieved by electroless deposition of a film of paramagnetic nickel/phosphorus material. However, prior to the electroplating of the main film, it is necessary for the paramagnetic nickel/phosphorus film, in accordance with the prior art techniques, to be burnished and polished so as to remove some of the nodules that result from the electroless deposition process.

U.S. Pat. No. 3,634,209, issued to Wolf describes a process for producing magnetic memory devices in which the nickel/phosphorus fine grain paramagnetic film is deposited on the substrate by electroplating means, and in which the main magnetic film is then electroplated over the paramagnetic film. However, again, in order to achieve the uniform density required for the Winchester-type of system, the paramagnetic nickel/phosphorus film must be polished and burnished prior to electroplating the main magnetic film.

The requirement for burnishing and polishing in the prior art methods is primarily due to the difficulty of maintaining constant current densities over the entire plating surfaces of the disc during electroplating. In particular, since the thickness of an electrodeposit at any point on a plateable surface is proportional to the time integral of the current density developed during electroplating, the lack of close control over current density in conventional electroplating apparatus has made it very difficult to plate magnetic surfaces capable of high density recording.

Accordingly, the prior art approach to provide a magnetic memory disc capable of high density recording and suitable for use in a Winchester system usually involves the following steps:

(1) An aluminum substrate is prepared by stamping a plate into the proper pre-defined dimensions. Standards have been defined by the American Society for Testing Materials for discs of fourteen inch, eight inch, five and one-quarter inch and 3.1 inch outer diameters.

(2) The substrates are then machined and stress relieved to obtain the finest tolerances possible.

(3) The substrates are then diamond turned and/or polished to an extremely fine finish.

(4) The polished substrates are then subjected to a series of plating operations to place a thin film of fine grain paramagnetic nickel/phosphorus material over the surface of the substrate. This film may be of the order of 0.0002 inches thick. The film may be deposited on the polished substrates either by electroless deposition techniques, or by electroplating as described in the Wolf patent.

(5) The coated substrates are then polished again in an effort to remove some of the nodules that result from the deposition process.

(6) After the polishing operation, the discs are reracked and subjected to an electroplating operation, for example, such as described in the Faulkner patent, so that the main magnetic film may be deposited over the paramagnetic film with the required overall degree of uniformity.

(7) A protective barrier coating may then be formed over the surfaces of the plated disc.

The prior art methods, as described above, are relatively expensive, especially in the requirements of the polishing and burnishing operations. These operations are usually performed manually, and are the leading causes for product failure.

Additional problems occur when the paramagnetic nickel/phosphorus film is deposited by electroless methods due to slight variations in the characteristics of the film over the surface of the disc. These variations result in major changes in the signal response during read/write operations.

An important objective of the present invention is to provide a method and process by which the paramagnetic nickel/phosphorus film may be deposited on the substrate by electroplating techniques, so as to obviate the problems encountered when electroless deposition is used, and by which the paramagnetic film is provided with a high degree of uniformity so as to eliminate any need for the time consuming and expensive manual polishing and burnishing operations.

There is another object of the present invention to provide a method and apparatus for the electrolytic plating of computer hard discs that is suitable for mass production.

It is a further object to the present invention to provide a method and apparatus of electrolytic plating that allows the current densities at the cathodes and anodes to be independently controlled.

These and other objects and advantages of the present invention will become apparent from a reading of the attached specification and appended claims.

DISCLOSURE OF THE INVENTION

The present invention is an apparatus for the electrolytic plating of computer memory discs that comprises: a plating bath container; a spindle rotatably mounted to the plating bath container; a prime mover connected to the spindle for applying rotational energy to the spindle; an anode fastened to the plating bath container; and an electrical transmission system connected to the disc on the spindle and to the anode for passing electrical current between the disc and the anode. The disc is mounted radially about a receiving area on the spindle. The anode is positioned relative to the plating bath container so as to be on opposite sides of the disc. The disc has a central aperture that fits about the diameter of the receiving area of the spindle. The disc acts as a cathode in the presence of current from the electrical transmission system. The disc is an aluminum substrate that has beveled edges about the inner diameter and about the outer diameter of the disc.

The spindle of the present invention includes a conductive rod extending through the interior of the spindle, a plurality of contact members in electrical contact with the conductive rod, and a busbar removably fastened to the outer diameter of the spindle. The contact members are electrically connected to the electrical transmission system by way of the conductive rod. The busbar is in electrical contact with the contact member and passes an electrical current to the inner diameter of the disc. The busbar is a cylindrical member that comprises an inner layer of conductive material and an outer layer on insulative material. The inner layer of conductive material is in contact with the entire inner diameter of the disc. An O-ring is engaged about one end of the cylindrical member. The O-ring abuts the disc so as to create a liquid-tight seal between the disc and the busbar.

The plating bath is contained by the plating bath container. The plating bath has a depth sufficient for the complete submerging of the disc. The plating bath has a concentration of a nickel compound contained therewithin. The plating bath also has a concentration of a phosphorus compound included therein.

The plating container contains an insulative separator which is fastened to and extends from the bottom of the plating container. This insulative separator is positioned between the anodes and has an edge that corresponds to the outer diameter of the computer memory disc. An air agitation system is positioned below the disc in the plating container. The air agitation system is a tube that extends between the anodes and the disc so as to pass gas across the surface of the disc. This air agitation system is fed by a suitable air supply external of the plating container. Also, a weir type flow control system is integrated into the plating container so as to direct the flow of the liquid plating bath in a direction parallel to the surface of the disc.

The anode is mounted to the bottom of the plating bath container such that the anode is aligned in a plane parallel with the surface of the disc. A plurality of anodes are arranged on opposite sides of the disc within the plating bath container. Each of these anodes comprises an anode member having an upper curved surface which corresponds to the inner diameter of the disc and a lower curved surface which corresponds to the outer diameter of the disc. Each anode also comprises a busbar member in electrical contact with the curved edge of the anode member. This busbar member is electrically conductive and insulated from the plating bath. The busbar member is also electrically connected to the electrical transmission system. Ideally, the anode member is comprised of platinum material.

The electrical transmission system comprises a plurality of current regulators connected to each of the anodes. The current regulator is for controlling the magnitude of current flow to the anode. The electrical transmission system is suitable for passing between 25 and 200 milliamps per square inch of surface area of the disc.

The prime mover causes the spindle to rotate at between 5 to 60 revolutions per minute. The prime mover comprises a motor that is external at the plating bath container. This motor has a shaft extending thereferom and a first gear fastened to the shaft. A second gear is connected to the spindle and engages the first gear. The actuation of the motor causes a corresponding rotational motion to be imparted upon the spindle.

The present invention is also a method of eletrolytically plating computer memory discs that comprises the steps of: (1) fastening the computer memory discs about a receiving section of a spindle such that the disc extends radially from the spindle; (2) submerging the computer memory disc entirely into an electrolytic plating bath; (3) rotating the spindle and the computer memory disc in the plating bath; and (4) transmitting an electrical current through the spindle to the disc. The electrical current that is transmitted to the disc is passed from the disc to an anode adjacent the disc in the bath. The disc is continually rotated while the current is being transmitted and the electrolytic plating continues.

The step of fastening comprises attaching a first cylindrical spacer about the outer diameter of the spindle; (2) sliding the central aperture of the disc over the outer diameter of the spindle such that the disc abuts an end of the first cylindrical spacer; and (3) fastening a second cylindrical spacer about the outer diameter of the spindle. The first and second cylindrical spacers have an electrically conductive layer for transmitting an electrical current to the inner diameter of the disc. The step of fastening further comprises the step of attaching an end cap about the spindle. This end cap has an end that abuts the second cylindrical spacer so as the fix the positions of each of the spacers and the discs relative to the longitudinal axis of the spindle.

The method of the present invention further comprises the steps of removing the electrical current from the disc, removing the discs and the spindle from the electrolytic plating bath, and removing the disc from the spindle.

BEST MODE FOR CARRYING OUT THE INVENTION

Figure 1:
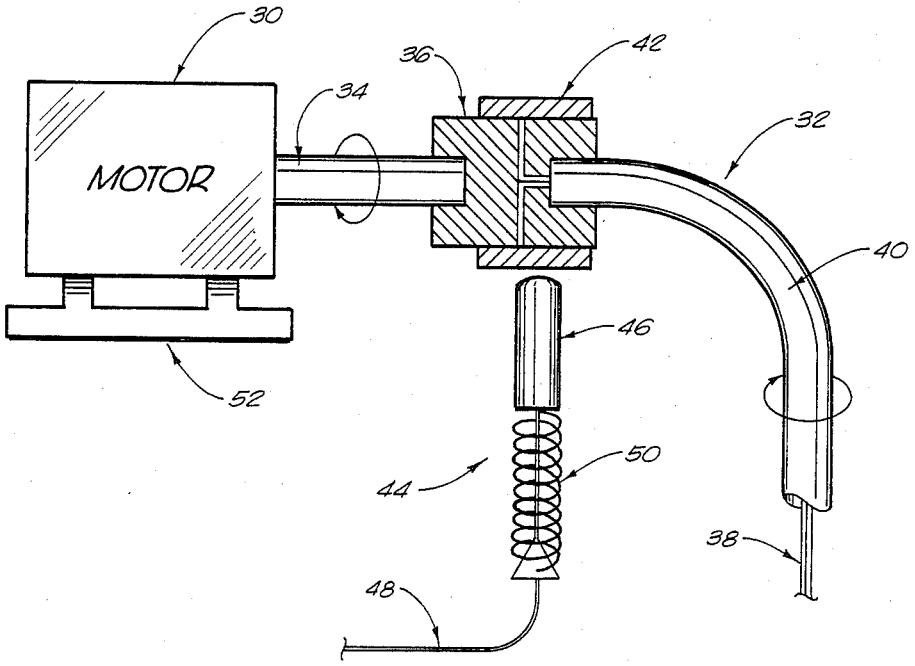
FIG. 1 shows a cross sectional view in side elevation of the motor which rotates the disc and the connector to the power supply.

The present invention is an apparatus for the electrolytic plating of layers onto a computer magnetic disc. As shown in FIG. 5, the present invention comprises a plating container 10, a spindle 12, a prime mover 14, anodes 16, and electrical transmission system 18. Discs 20 are mounted on spindle 12 and act as the cathodes in the electrolytic plating process of the present invention. Each of the components of the present invention, as shown in FIG. 5, are shown in greater detail (and in different form) in FIGS. 1–4.

In FIG. 1, there shown the prime mover and a portion of the electrical transmission system of the present invention. As shown in FIG. 1, motor 30 is a motor of either set or variable rotational speed. By being mounted to the top of or adjacent to the plating fixture, motor 30 transfers its rotational energy along the shaft 32 to the spindle and attached disc. Shaft 32 is connected to motor shaft 34 via a rigid coupling 36. Shaft 32 is a flexible drive which, when rotated at one end, effects rotation at the other end. Shaft 32 is composed of two parts, an inner conductive wire of braided copper wire 38 and an outer nonconductive insulating covering 40. Rigid coupling 36 serves to transfer rotational energy from the motor shaft 34 to the flexible drive 32 and to maintain electrical contact with the discs as they rotate on the spindle. The inner conductive wire 38 is connected to the outer surface 42 of the coupling 36. Coupling 36 is a smooth cylinder of copper. Electrical energy is transferred to the conductive wire 38 by the use of a commutator brush 44. Commutator brush 44 can be found at most electrical motors. Brush 44 is comprised of a piece of carbon 46 which is conductively attached to a source of electrical energy by a wire 48. Wire 48 is kept in mechanical contact with the copper cylinder 42 of coupling 36 by a spring 50. Motor 30 is rigidly fastened to a base 52.

Figure 2:
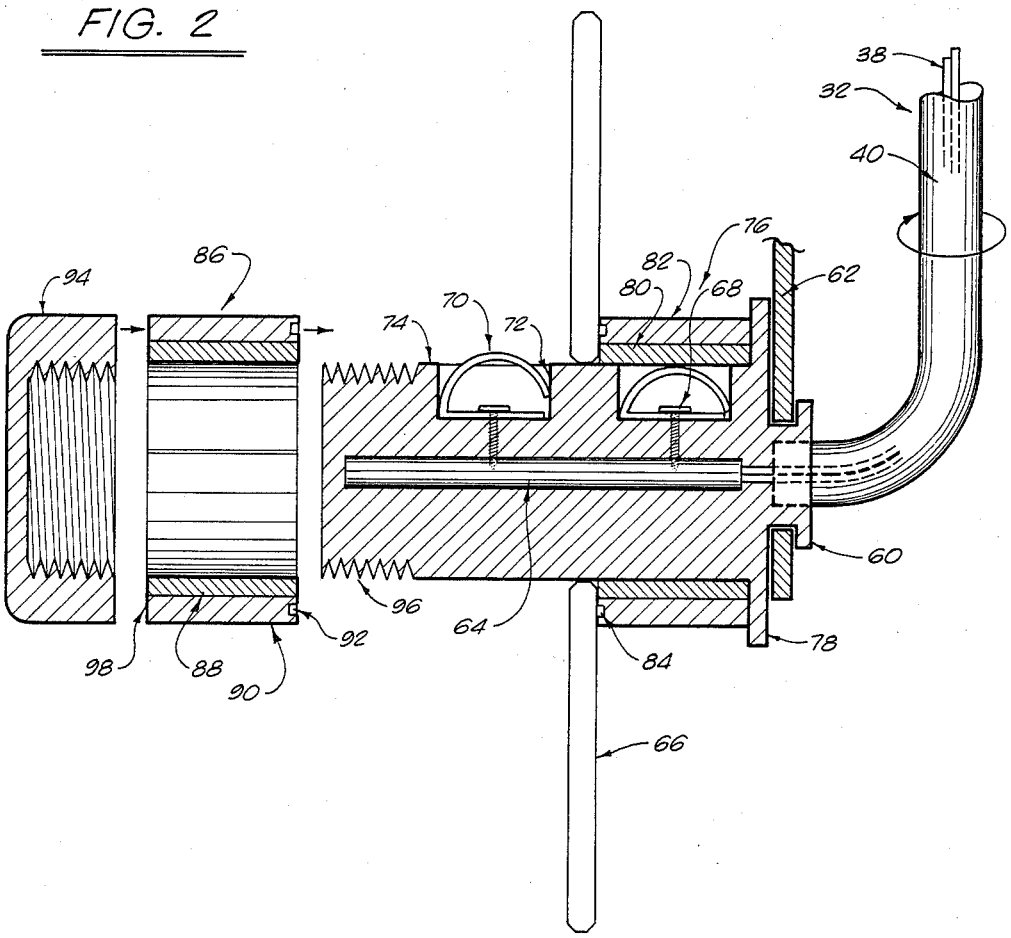
FIG. 2 is a cross sectional view in side elevation of the fixturing for the computer memory discs and the means for supplying them with current as cathodes.

FIG. 2 shows the mechanism by which rotational and electrical transference, to the computer memory discs (as cathodes), is maintained with the motor and power supply of FIG. 1. The flexible shaft 32 is rigidly attached to a non-conductive spindle 60. Non-conductive spindle 60 has an outer diameter that is just barely large enough for the internal diameter of the disc to fit over and onto. Spindle 60 is fastened to and rotates in unison with flexible shaft 32. The rotating spindle 60 is maintained mechanically stable by the use of the plating bath fixture frame 62. The conductive cable 38 is attached to a copper rod 64 which runs through the center of spindle 60. Conductive screws 68 are located one half of the way between each disc 66 on the spindle 60. Conductive screws 68 are contact members which maintain electrical contact between the copper rods 64 and folded copper contact strips. Contact strips 70 are inset into grooves 72 cut in to the spindle 60 at points between each disc. The folded portion of strip 70 juts above the level of the outer diameter 74 of spindle 60. Cylindrical spacer 76 is positioned about the outer diameter 72 of spindle 60 between lip 78 and disc 66. Cylindrical spacer 76 is slipped over the spindle 60 such that the flexible band of contact strip 70 is compressed so that a good electrical contact becomes established. The inner portion 80 of spacer 76 is comprised of a conductive material, such as copper. The outer portion 82 is comprised of a insulator, such as polypropylene. The inner, conductive portion 80 of spacer 76 maintains contact between the contact strip 70 and the disc 66. Disc 66 fits between each spacer as the spacer is placed over the spindle 78. A firm contact is maintained between the inner portion 80 of the spacers 76 and the disc 66 by compressing them against each other. An O-ring 84 is placed into a notch formed about the outer portion 82 of spacer 76. O-ring 84 is compressed against the surface of disc 66 such that O-ring 84 maintains a fluid-tight contact between the disc and the outer portion of spacer 76.

A second spacer 86 is also placed over the outer diameter 74 of spindle 60. Spacer 86 is placed on the opposite side of disc 66. Spacer 86 is a cylindrical member having an inner conductive layer 88 and an outer insulative layer 90. As with the first spacer 76, an O-ring 92 is fitted about the end of spacer 86 adjacent disc 66. O-ring 92 maintains fluid-tight contact between the disc 66 and the spacer 86. Electrical energy is passed from contact strip 70, through conductive layer 88, to the inner diameter of disc 66.

An end cap 94 is threaded onto the end 96 of spindle 60. End cap 94 abuts the end 98 of spacer 86. The firm contact between the spacers 76 and 86 against disc 66 is maintained by tightening the end cap 94 about the threaded area 96 of spindle 60. Lip 78 at the opposite end of the spindle 60 serves as a back stop to the pressure caused by the threading of the end cap 94.

In FIG. 2, the support structure 62 and frame for the plating bath fixture 10 is shown as giving support to only one end of the spindle 60. This is shown for diagrammatic simplification. Various modifications, as will be described hereinafter, can be made to the arrangement shown in FIG. 2 so as to optimize the design of the present invention.

Figure 3:
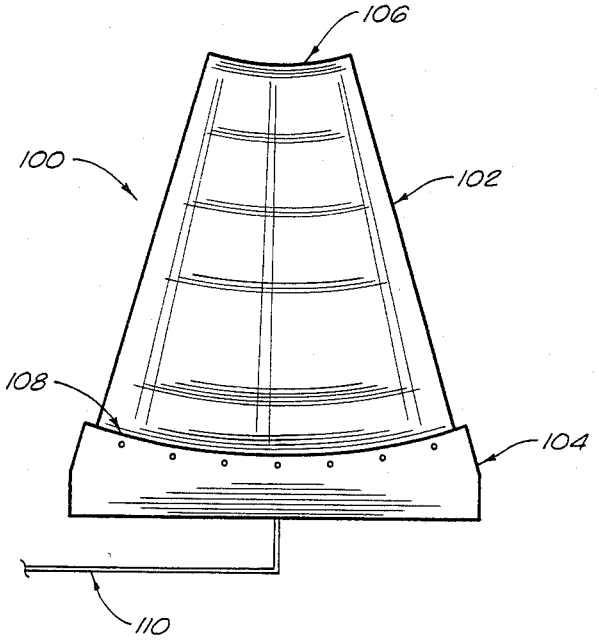
FIG. 3 is a view of the anode assembly.

FIG. 3 illustrates the anode 100 of the present invention. Anode 100 is comprised of anode member 102 and busbar member 104. The anode member 102 is shaped such that the spacers 76 and 86 between the discs will fit adjacent and into the upper curved portion 106 of anode member 102. Upper curved portion 106 is located generally about the vertex of anode member 102 and corresponds to the inner diameter of the discs. The lower curved portion 108 of the anode member 102 corresponds to the outer diameter of the discs. When the fixture and spindle are lowered into the plating bath, the lower curved portion 108 of the metal of anode 102 is exactly and evenly aligned with the outer diameter of the discs. This is also the case at the inner diameter of the discs and the corresponding upper portion 106 of anode member 102 except for a slight overlap of the disc surface about the inner diameter by the spacers 76 and 86 of FIG. 2. Anode member 102 is preferably comprised of platinum.

Busbar 104 is made of a copper material and conforms to the lower curved surface 108 of anode member 102. Busbar 104 is insulated from physical or electrical contact with the plating bath and is connected to the power supply by insulated electrical connection 110. Busbar 104 is designed so as to evenly distribute the current received from anode member 102.

Figure 4:
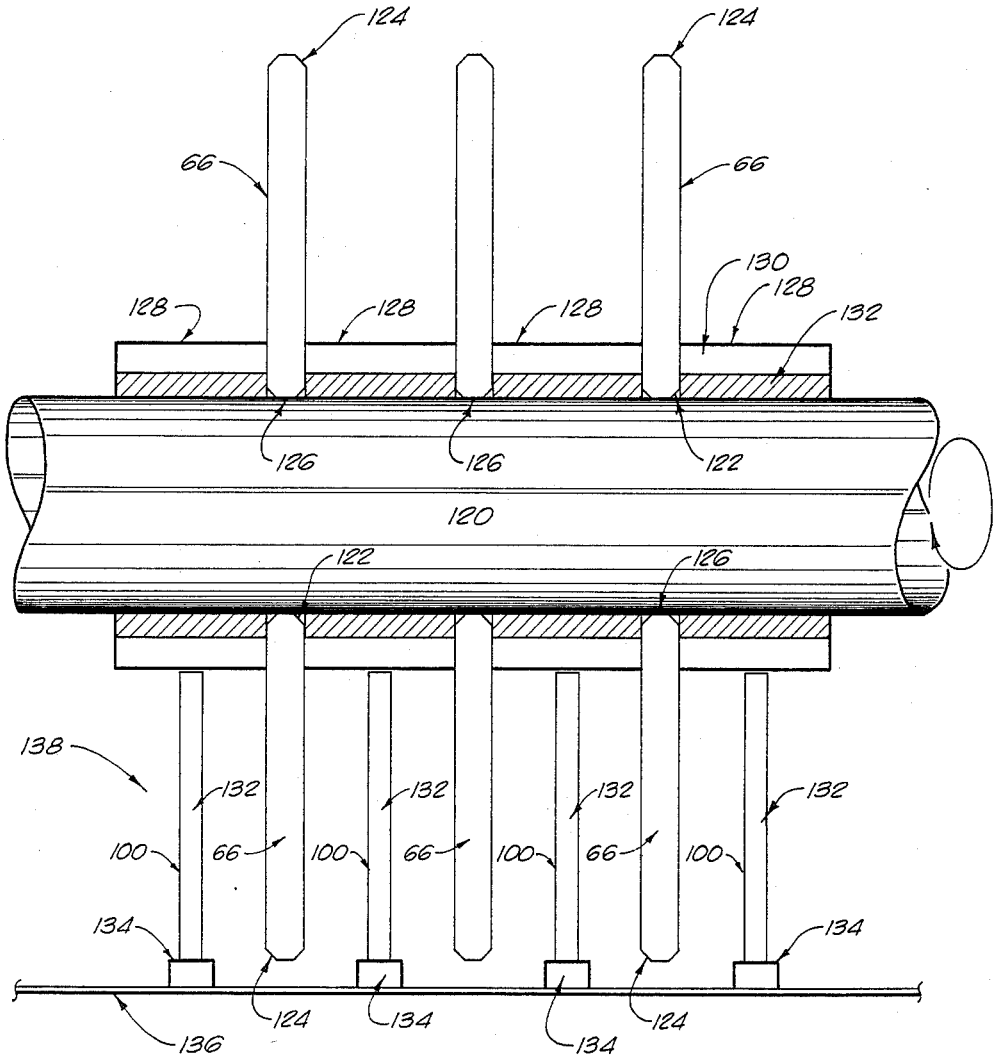
FIG. 4 is a view in side elevation of the arrangement of the rotatable spindle and cathode-anode.
Figure 5:
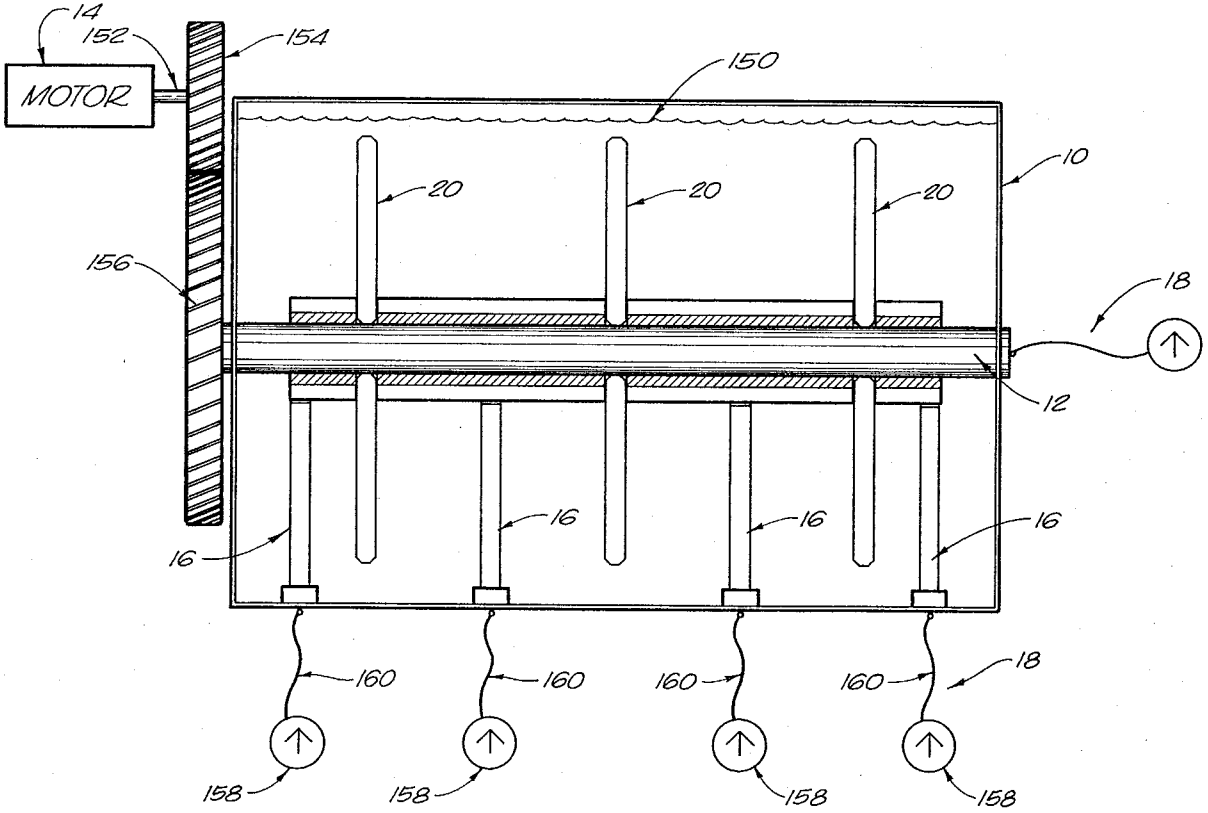
FIG. 5 is a cross-sectional view in side elevation of the plating bath container having an alternative arrangement of the spindle and electrical transmission system.

FIG. 4 illustrates the relative arrangement of the anodes 100 to the discs 66. As shown in FIG. 4, three discs 66 are mounted onto spindle 120. Discs 66 have beveled inner diameter edges 122 and beveled outer diamter edges 124. Discs 66 are an aluminum substrate material. Although FIG. 4 shows the mounting of three discs 66, any number could be mounted in practice. The three discs 66 are placed onto receiving portions 126 of spindle 120 and are separated by spacers 128. As shown in FIG. 4, four spacers are used to separate and position the discs. The spacers 128 are slipped over onto the spindle, as are the discs, when the spindle 120 is first loaded. In each of these instances, the spacers 128 are fitted over conductive strips 70. Each of the spacers 128 has an outer insulating layer 130 and an inner conductive layer 132. Inner, conductive layer 132 serves to transfer electrical energy from conductive strip 70 to the inner diameter of discs 66.

In FIG. 4, four anodes 100 are illustrated. These anodes 100 include anode member 132 and busbar 134. Each of the anodes 100 is positioned between the discs 66 and below the spindle 120. The anodes 100 can be permanently mounted in the bottom 136 of plating tank 138. The loaded spindle 120 and fixture can be lowered into position as shown in FIG. 4. The individual anodes 100 are shown from the side and are identical, in configuration, to that described in FIG. 3. Essentially, anodes 100 are maintained in plane parallel to discs 66. Ideally, anodes 100 should be placed at equal distances from the surfaces of discs 66.

In FIG. 4, the anode-to-disc spacings are dependent upon the size and type of disc, the conductivity of the plating bath, the degree of air agitation as it affects conductivity, the desired current range, and many other factors may be varied as needed. In the present invention, the preferred embodiment has a spacing for a 5¼ inch disc of 5,086 aluminum alloy of approximately one half inch. In alternative embodiments and utilization of the present invention, the spacing may be anywhere from 0.15 inch to approximately 6 inches between the anodes and the discs.

FIG. 5 shows an alternative, but similar, embodiment of the present invention. FIG. 5 shows a generalized view of plating bath container 10. Plating bath container 10 can be any three-dimensional container that has a volume sufficient for the containment of the discs and plating solutions. An essential requirement of the present invention is that the discs 20 must be completely submerged within the plating bath.

In FIG. 5, the plating bath is illustrated at 150. In the preferred embodiment of the present invention, the plating bath has the following components and concentrations:

100 grams/liter of Nickel Sulfate
30 grams/liter of Boric Acid
20 grams/liter of Sodium Formate
15 grams/liter of Phosphite
4 grams/liter of Sacharrin
2.5 grams/liter of Sodium Hypophosphite Each of these components and concentrations is maintained in 14 megaohm resistance deionized water. Although the composition and concentrations of materials in the plating bath can be varied in accordance with the circumstances encountered, it is important to realize that two components are important to the preferred embodiment of the present invention. These two compenents are: a nickel compound and a chemical that contains phosphorus. The nickel compound is essential to the proper plating of the disc. In order to deposit this nickel in a non-magnetic form, it is necessary that from ten to fifteen percent of the deposit be phosphorus.

The pH of the plating bath is preferably at 4.45. However, the range of pH can be from 4.7 to 4.10 without significantly affecting the plating characteristics of the present invention. The pH of the bath will tend to decrease as deposition of nickel occurs and can be raised by the addition of nickel carbonate. The bath pH can be lowered by the addition of dilute sulfuric acid. In the bath of the present invention, filtration at point 0.02 microinch absolute is required. The bath temperature in the preferred embodiment of the present invention can range from 100 degrees to 160 degrees Fahrenheit.

FIG. 5 shows certain variations to the configuration of the present invention. First, primer mover/motor 14 is connected by shaft 152 to a first gear 154. First gear 154 is interactive and connected with second gear 156. Gear 156 is attached to spindle 12. The interaction of the gears in combination with motor 14 creates the rotating action of spindle 12. In the preferred embodiment of the present invention, spindle 12 is rotated at between 5 and 60 revolutions per minute. Spindle 12 maintained within plating bath container 10 by any number of suitable attachment means.

A second variation depicted in FIG. 5 is the use of separate current regulators 158 electrically connected by lines 160 to anodes 16. The separate current regulators 158 permit individualized control over the current flowing into anodes 16. As a result, greater control can be maintained on the deposition of non-magnetic nickel onto the surfaces of disc 20. This will permit more individualized control over variables which may affect the electrolytic plating process of the present invention. For example, if the layer of nickel on disc 20 becomes too thick, the current flowing into anodes 16 can be reduced by a proper adjustment of current regulator 158.

Figure 6:
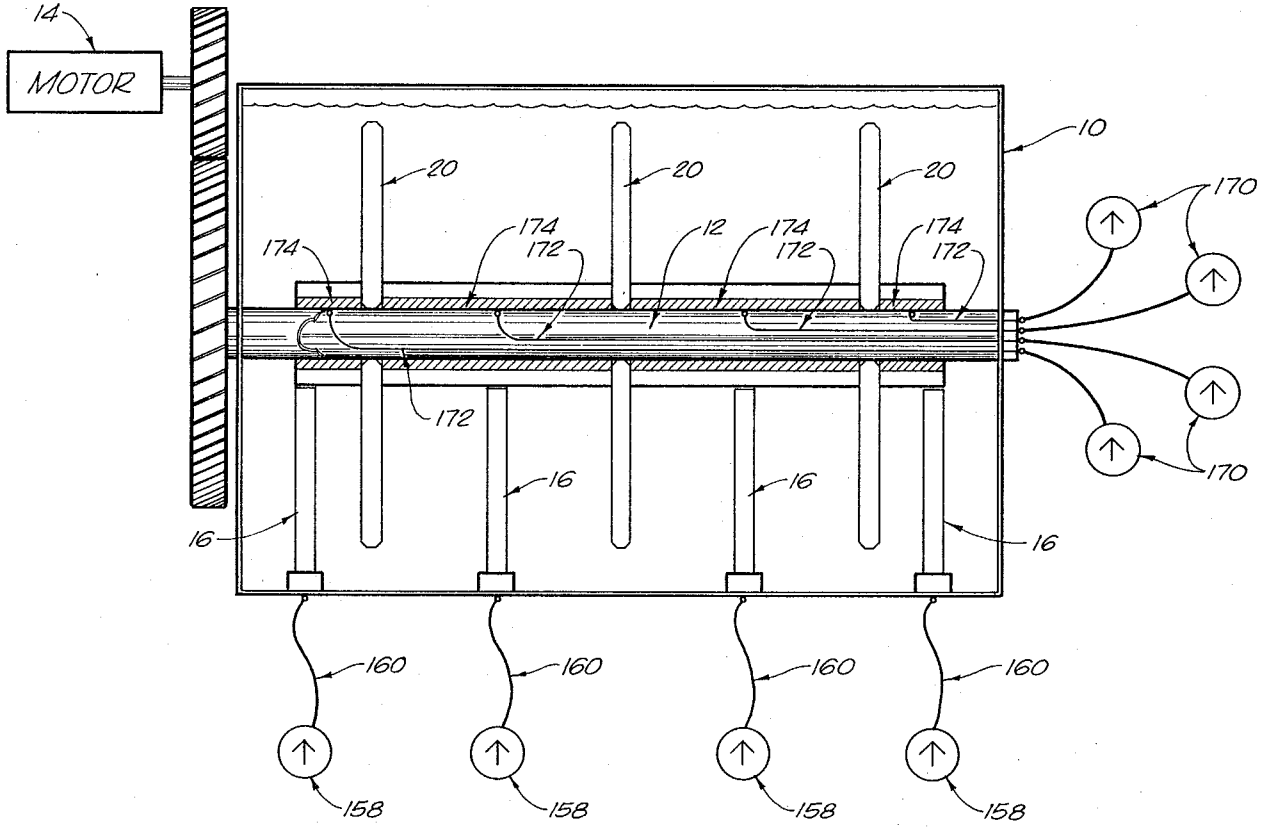
FIG. 6 is a view similar to that of FIG. 5 which shows an alternative embodiment of the electrical transmission system.

In FIG. 6, a further modification of the present invention is shown. In particular, separate current controllers 170 are connected by line 172 to busbars 174. These front controllers 170 permit greater control over the current flowing into busbars 174. Thus, the modifications shown in FIG. 6 permits the operator of the electrolytic plating apparatus a greater degree of control over the thickness, constitution, smoothness, and consistency of the nickel deposition onto disc 20.

Figure 8:
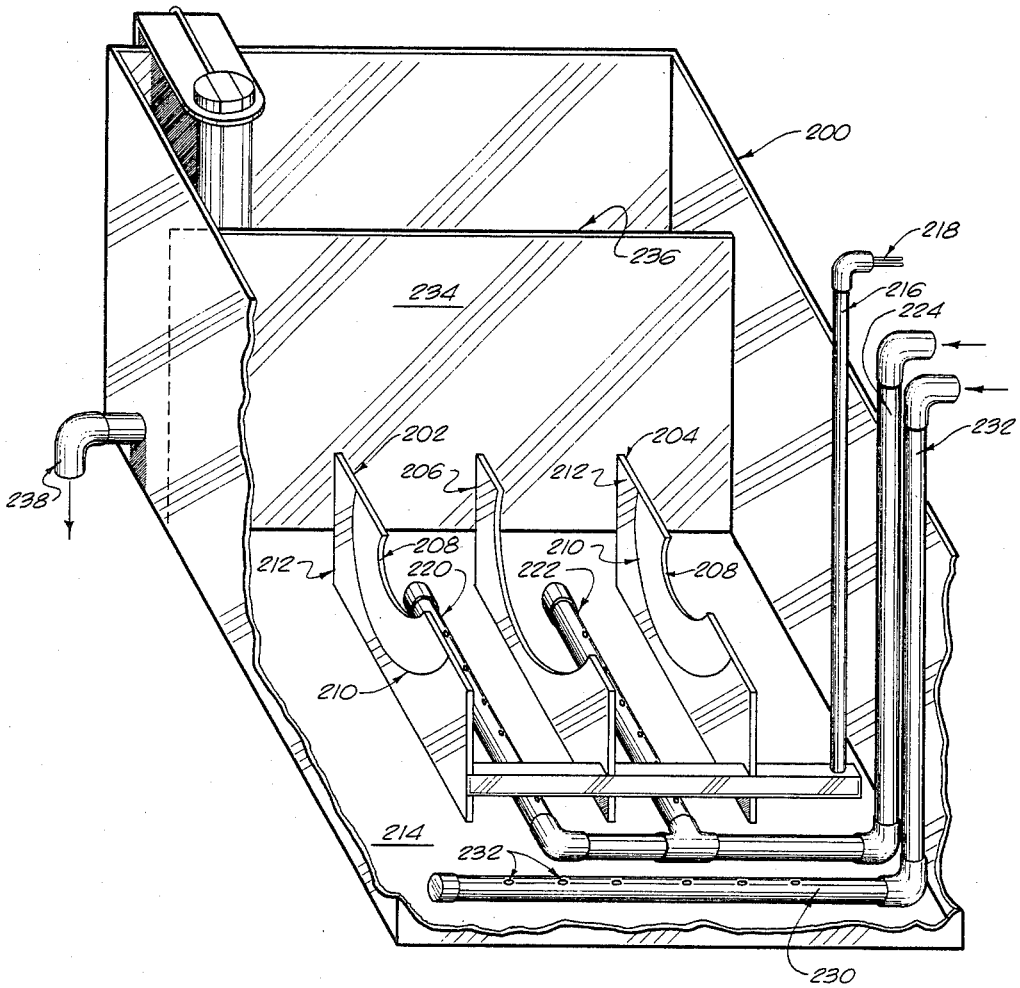
FIG. 8 is a cutaway perspective view of the internal configuration of the plating container of the present invention.

FIG. 8 shows the interior configuration of the plating bath 200. FIG. 8 illustrates the plating bath without the fixturing, spindle, or discs. Plating bath 200 has anodes 202 and 204 on opposite sides of an insulative separator mask 206. It can seen in FIG. 8 that anodes 202 and 204 have an upper curved portion 208 that corresponds to the inner diameter of the disc. The lower curved portion 210 of anodes 202 and 204 corresponds to the outer diameter of the discs. Busbar member 212 maintains the anodes 202 and 204 in an upright position extending perpendicular from the bottom 214 of plating bath 200.

Insulative separator mask 206 serves to balance the current on the two anodes which act on each face of the disc. Since each anode affects the other in its drawing of current, it is useful to provide this plastic mask 206 between the anodes 202 and 204. It is also important that plastic mask 206 be fastened directly underneath the disc and precisely cut to conform to the circle cut by the disc on its outer edges. Insulative separator 206 effectively compartments individual forms on either side of the disc and between anodes 202 and 204. Anodes 202 and 204 are supplied with current through conduit 216. Conduit 216 allows electrical lines 218 to extend from external of the plating bath 200 to the anodes 202 and 204.

Air agitation is important to the proper plating characteristics of the discs. This air agitation is provided by perforated tubes 220 and 222. Perforated tubes 220 and 222 are connected to and communicate with central tube 224. Central tube 224 connects to a supply of gas external of the plating bath 200. The perforated tubes 220 and 222 fit between the anodes and discs. Each disc to be plated by the present invention has two such air tubes 220 and 222 extending parallel and passing air parallel to the plane of the disc surface. The combination of the air agitation as provided by tubes 220 and 222, along with the rotational method of the present invention, has a synergistic effect and allows a reproducibly homogenous deposit.

FIG. 8 also illustrates a solution flow control system 230. Flow control system 230 acts to direct the flow of solution of the liquid plating bath in a direction parallel to the surface of the disc being plating. Flow control system 230 has perforations 232 occuring along the upper surface of the tube at the bottom 214 of plating bath 200. Flow control system 230 is also placed about the forward portions of the plating bath 200. As shown in FIG. 8, this tube 230 is placed toward the bottom forward portion of the plating bath 200. Flow control system 230 is provided with plating bath fluid through conduit 232. Conduit 232 communicates with a supply of plating solution external of plating bath 200. The plating bath solution is removed from the interior of tank 200 by passing over weir 234. As the level of fluid rises above the top edge 236 of weir 234, the fluid flows over top 236 and exits through exit tube 238. The plating bath fluid can then be recirculated, filtered, treated, or otherwise altered to make it suitable for reuse. Alternatively, the solution can be discarded.

The method of the present invention is directed to the technique of electrolytically plating computer memory discs. The first step in this method is to fasten the computer memory disc 66 about a receiving section 126 of a spindle 60. When affixed in this position, the computer memory disc 66 extends radially from the spindle 60. The second step is to submerge the spindle and the computer memory disc into an electrolytic plating bath. As shown in FIG. 5, the discs are entirely submerged into this plating bath 150. The plating bath has a composition that was described herein previously. The third step of this process is to rotate the spindle 12 and the attached discs 20 in the plating bath. Fourthly, an electrical current is transmitted through the spindle to each of the discs on the spindle. The electrical current passes from the discs to the anode 16 adjacent and parallel to the discs. The discs are rotated until the plating is complete. The current is applied continually during the rotation of the spindle 12.

The step of fastening the disc to the spindle has been described herein previously. Essentially, a first spacer 76 is placed about the outer diameter of the spindle 60. Next, the central aperture of disc 66 is slidingly passed over the outer diameter of the spindle and placed so as to abut the end of spacer 66. Thirdly, a second cylindrical spacer is placed about the outer diameter of the spindle such that one end of this spacer abuts the opposite side of disc 66. An end cap is then placed about the end of the spindle and is threadedly connected so as to place a compressive force on the spacers 76 and 86.

When the plating process is completed, the process of the present invention involves the following steps. First, the electrical current is removed from the disc and the anode. Secondly, the disc is removed from the electrolytic plating bath. Finally, the disc is removed from the spindle.

In the present invention, the disc serves as the cathode in the electrolytic plating process. In this process, the disc is rotated in front of the anode as plating occurs. This technique results in a number of benefits, which will be described hereinafter.

The rotation of the disc allows the critical mechanical surface requirements to be achieved over the entire surface of the disc. These mechanical surface requirements would be impossible to maintain without rotation. The rotation evens out the disc/anode allignment an initial disc substrate. Without rotation, these alignment or unevenness problems would be further amplified. In order to achieve perfectly even plating current densities from the inner diameter to the outer diameter of the disc, it is necessary that the thickness of the anode must be of a calculated thickness that gives a conductance equal to that resulting from the thickness of the disc and the particular type of aluminum alloy of which it is composed. If equally sized strips of both the anode and aluminum cathode materials are attached to a current supply, then the ohmic resistence of each must be equal. This is accomplished by having a proper thickness of plantinum anode sheet material. The anode to cathode geometry must be such that the anode dimensions are some exact subdivision or pie cut of the disc dimension. In other words, some number of identical anode pieces, if pieced together, should form an identical replica of the circular disc/cathode. It is also necessary that a busbar type arrangement be applied to both the anode and disc/cathode. The lower, outer portion of the anode (which is analogous to the outer diameter of the disc) must have a fairly heavy, highly conductive, and preferably copper contact attached. This contact must be shielded from exposure to the bath and insulated. In addition, it must not shield or extend into the area which is analogous to the disc dimensions. The disc/cathode must likewise have a busbar-type attachment at its center or inner diameter. This busbar-type attachment may only mask a small portion of the inner surface and must be insulated and not exposed to the plating bath. The busbar acts to insure an even current density distribution and will prevent hot spots or disparities from occuring along the disc surface.

In this arrangement, the critical concept is to have the positive current supply at the outer diameter or lower portion of triangular anode and the negative attachment at the inner diameter of the disc cathode. It is also important to have an exact anode thickness (dependent upon anode composition, disc diameter, thickness, and alloy) which would correspond to a resistivity or conductant equal to that of a duplicate triangular piece, i.e. anode shaped piece, cut from an aluminum computer memory disc substrate. The geometrical symmetry, cathode inner diameter to anode outer diameter current flow, the use of a busbar for both anode and cathode, and the calculation of a proper anode thickness are considerations that influence the workability and effectiveness of the present invention.

If the above-described anode arrangement is used to plate a plurality of discs, it is preferable to have those anodes positioned between adjacent discs to have twice the thickness as the anode which would be adjacent one disc. This will facilitate evenness of current distribution. It is also possible to separate equally sized anodes with an insulative layer such as a thin sheet of plastic. In this manner, each of the two sides of a disc will have a dedicated corresponding anode.

Figure 7:
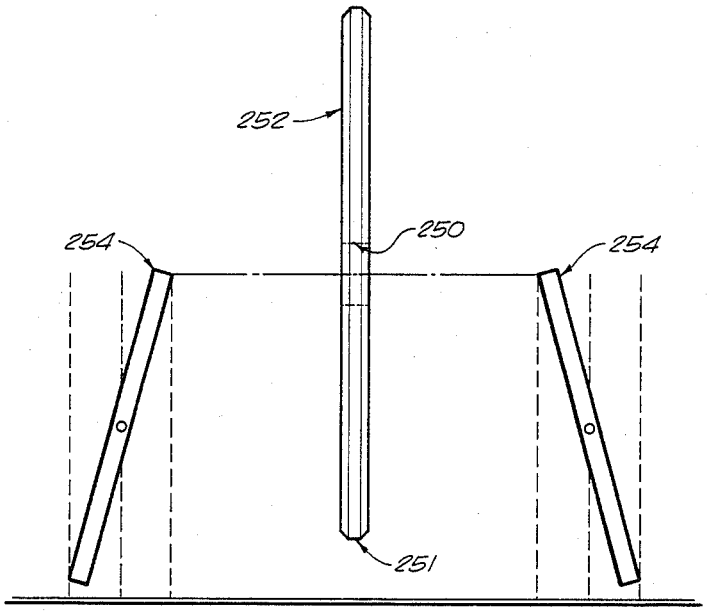
FIG. 7 shows a cross sectional view in side elevation of an alternative arrangement of the anode/disc configuration within the plating container of the present invention.

FIG. 7 illustrates an alternative arrangement which could be used to vary the deposit thickness from internal diameter 250 to external diameter 251 of disc 252. In FIG. 7, anodes 254 are connected to mechanisms which control the inclination of the anodes 254 relative to the surfaces of disc 252. This inclination control system is operationally interactive with the anode for controllably changing the angle of approach of the anode relative to the disc. In the scheme illustrated in FIG. 7, the tilting of the anodes 254 would allow a greater deposit of plating material to be deposited adjacent the inner diameter 250. In this arrangement, less plating material would be deposited about the outer diameter 251. In the alternative embodiment illustrated in FIG. 7, anodes 254 could be controlled by a microprocessor to distribute plating material over curved surfaces occurring on the surface of disc 252. In many situations, the inner edge 250 and outer edge 251 of disc 252 are somewhat beveled. To accommodate this beveled edge, it would become necessary to deposit greater amounts of plating material at these beveled portions. The controlled movement and inclination of anodes 254 could be used to accomplished this purpose.

The technique of rotating the disc/cathode is more suitable for high volume production since the plating rate is higher via the increased solution flow at the active plating surface. The rotation of the discs will naturally have greater surface contact with the plating solution.

The use of the electrolytic method of computer memory disc plating offers a number of benefits over the previous electroless methods of deposition. In particular, the nodularity problem of electroless deposition is no longer a problem with the present invention because the electrolytic deposition occurs as if on a crystalline surface and proceeds in layer and lattice steps. The lifetime of the plating bath is potentially infinite in the electrolytic method. The plating bath cannot decompose because there are no plating by-product poisons evolved. The bath constituents are not prone to rapid changes and can be easily maintained at constant levels by the use of an amp/hour meter. Additionally, particular contaminants in an electrolytic bath tend to be repelled from the surface of the work piece as plating commences and are not co-deposited onto the surface of the disc.

In order to deposit nickel in a non-magnetic form, it is necessary that from 10 to 15 percent of the deposit be phosphorus. This is accomplished by the addition of phosphorus to the plating bath. In order to have a high level of phosphorus, it is necessary that a low pH of about 4 be maintained. Semi-bright nickel plating usually requires the addition of certain addition agents as brighteners, levelers, and stress relievers. Only a few of these operate at a low pH and many of these decompose if subjected to pulse plating. On the other hand, these addition agents are stable under constant current DC plating. These addition agents have been found to be useable under the present invention. The ability to use these addition agents is cumulative with the benefits of pulse plating, such as fine grain size, leveling, and smoothness. All of these benefits can be achieved by the rotational process of the present invention.

As a disc rotates, any one spot on its surface passes between the anode and experiences a current pulse. This pulse initiates metal deposition. This corresponds to the "on" time in regular pulse plating techniques. The length of this "on" time is a function of the disc rotation speed and the circumferential width of the wedge-shaped anode. The current to the anodes remains on continuously as the disc rotates. As any one area of the disc passes away from the space between these anodes, that area no longer sees any current. This corresponds to the "off" period in normal pulse plating. This "off" period is also a function of the disc rotation rate and the circumferential distance to which the disc must rotate in order to come back to the anodes.

The effect of the disc rotation past the anodes is similar to the effects of regular pulse plating. Metallic cations existing essentially on the surface of the disc in the Helmholtz layer are highly mobile across the crystal lattices found there. In simple terms, like herds of cattle, they tend to congregate and plate out or be adsorbed at areas of high energy on the charged lattice. If the driving current is high, then small differences in charge between different points on the surface become negligible and no herding occurs. The metallic ions are literally thrown down onto the surface and remain wherever they land. This does not result in the most desirable desposit. A typical cubic nickel crystal is roughly 60 angstroms to a side. The optimum condition is to have the "on" time and current as the disc passes the anodes correspond to the nucleation energy plus the energy in amp-seconds (as calculated from Faraday's law) required to deposit an amount of metal roughly equal to the thickness of one such cubic crystal over a surface on the disc equal to that of the anode. This estimation should be made as if the anode and disc are stationary relative to each other.

As the portion of disc under consideration moves out of the vicinity of the anodes and is essentially in the "off" period of the cycle, mobile cations of relatively low energy on the disc surface are captured by similarly low energy lattice steps. The growth of the individual nucleation sites, as grains or crystal, gradually ceases as the capacitive layer is discharged and all available nucleation sites are occupied. In constant current DC plating, this gradual occupation of low energy nucleation sites does not occur and the original grains continue to grow in size as the thickness of the deposit increases. As the disc portion moves back into the "on" cycle near the anodes, the grains deposited during the previous cycle do not continue to grow in size because all available sites have been filled and the crystal has undergone a complete growth process. The lattices on the individual grains are now available as nucleation sites for new grains to develop. When depositing the nickel base layer, a very fine and homogeneous grain structure throughout the deposit results in an extremely smooth and even surface finish or profile. There is less variation of grain size and also of composition relative to the thickness of the layer. This is of considerable benefit in plating a thin film magnetic layer.

A general benefit to the disc rotation process is that the rotation itself provides an easily controllable means by which to change or alter the deposit characteristics by simply changing the rotation rate. The grain structure and the morphology of the individual grains are affected by the change of the rotation rate. The ability to control the morphology of the grain structure is displayed in varying distributions and combinations of grain sizes. The spacing of the grains relative to one another is a major factor which gives the ability to deposit a smoother, mechanically superior surface.

Importantly, the rotation rate is yet another means of control, (in addition to pH, temperature, air, agitation, and current density) by which the nickel-to-phosphorus ratio can be precisely controlled. This means of control extends to the deposition of any such alloys, including those of nickel, cobalt, and phosphorus. Without altering the chemical constituents of the plating bath, the process of the present invention can be used to deposit an amount of cobalt. This cobalt can be deposited and controlled in relation to the nickel and phosphorus. This technique of controlling the rotation and the ability to change rotation from one speed to another allows a layered structure of varying compositions to be manufactured. This technique would also permit soft magnetic films, such as nickel/iron alloys, to be deposited onto the surface of the disc.

The cathode overpotential associated with the current density is a result of the need to charge the electric double layer at the cathode/solution interface. This electric double layer acts as a capacitor. Once this overpotential has been reached and the layer charged, metal deposition begins according to Faraday's law. The rotation of the disc/cathode substrate through the solution results in a significantly thinner capacitive double layer or diffusion layer due to the increased agitation at the interface. Since the thickness of this diffusion layer approaches the profile heights of the average microirregularities on the surface, the layer tends to conform to the surface. There will be more metal deposited on the peaks than on the recesses when the diffusion layer is significantly thicker than the heights of the peaks. As a result, any initial roughness is amplified. On the other hand, a thinner diffusion layer tends to conform to and follow the surface profile like a second skin. The peaks and recesses are then equally accessible and a high throwing power is the result. This occurs during the "off" time during rotation. An observation of the deposits as plated from this method show that a highly levelling type of deposit is occuring during the "off/on" time of the cycle. This leveling deposit is primarily the result of the type of bath and current densities used along with the rotational dynamics of the present invention. In the present invention, both a leveling deposit and a high throwing power type of deposit are occurring in the same bath. It is believed that this results in the exceptional quality of plate produced.

The present invention eliminates the problems of oxidation and handling during transfers. Since the cathode is rotated on a central shaft from the inner diameter, the same fixture used in the plating can also be used in the pre-treatment process. There is no need to change fixtures. The rotation of the disc during pre-treatment results in an improved and highly homogeneous surface. This is particularly true for any zincated film that is introduced.

The utilization of a sealing type of O-ring in the spacers of the present invention keeps the plating bath from contacting the busbar portion of the spacer. This sealing type of arrangement prevents electrolytic buildups at the fixture and at the interface between the busbar and the disc. This eliminates much of the time that would be required for proper cleaning and maintenance of the spindle assembly.

Since the present invention ideally incorporates platinum anodes, there is no problem with the decomposition of the anode structure. As opposed to the use of nickel anodes, platinum anodes will not decompose and result in a soot buildup. The soot buildup can produce irregularlities on the disc surface and inhibit the optimum performance of the present invention. Another problem with nickel anodes is the tendency to cause an increase in the nickel concentration in the bath during the plating process. Over time, the use of nickel anodes requires that the bath be diluted on a continuous basis. The platinum anodes, on the other hand, result in no soot buildup and enhance the ability to maintain the life of the plating bath.

The present invention results in the improvement of the plating rate and the ability to increase the cathode-to-anode surface area without harming the deposit characteristics. The rotation technique of the present inventinon causes a thinner diffusion layer. The thinner diffusion layer can charge and discharge faster. The rotational speed can thus be increased accordingly to achieve a desired leveling-to-throwing power ratio. Higher relative current densities can be achieved without depletion of the anodes.

The present invention greatly simplifies the process of manufacturing computer memory discs. First, the number of process steps required in memory disc production is greatly decreased by the use of the electrolytic, as opposed to the electroless, processing technique. Secondly, the high quality end product eliminates many of the process steps required to correct defects in the surface quality of the computer memory discs and to polish and/or burnish the surface of the disc. Thirdly, the arrangement of multiple discs on a single spindle greatly enhances the production capabilities. Fourthly, the arrangement of the apparatus lends itself to complete automation. Since the number of process steps in the manufacture of computer memory discs is reduced, the cost of manufacturing is reduced and the output of manufacturing is greatly increased.

The foregoing disclosure and description of the invention is illustrative and explanatory thereof, and various changes in the method steps, as well as details in the illustrated apparatus may be made within the scope of the appended claims without departing fromt the true spirit of the invention.

I claim:

1. An apparatus for the electrolytic plating of a computer memory disc comprising:

plating container means for receipt of a liquid plating bath;

spindle means fitted to said plating container means, said spindle means having a receiving area for fixing to the inner diameter of a computer memory disc;

prime mover means connected to said spindle means for applying rotational energy to said spindle means, said spindle means rotatable within said plating container means;

stationary anode means fixed and nontranslatable relative to said plating container means, said stationary anode means positioned so as to be distal from and on opposite sides of said receiving area on said spindle means, said stationary anode means comprising:

an anode member having an upper curved edge which corresponds in shape to the outer diameter of said spindle means, and having a lower curved edge, said anode member having a shape corresponding to a pie-cut of a disc; and a busbar member in electrical contact with said lower curved edge of said anode member; and electrical transmission means connected to said spindle means and to said stationary anode means, said electrical transmission means including a contact surface, said contact surface suitable for generally continuous electrical contact with the entire inner diameter of a computer memory disc, said electrical transmission means for passing a current between said contact surface and said stationary anode means.

2. The apparatus of claim 1, said spindle comprising:

a conductive rod extending through the interior of said spindle means;

a plurality of contact members in electrical contact with and extending from said conductive rod, said electrical transmission means being electrically connected to said conductive rod for passing a current to said contact member; and busbar means removably fastened about the outer diameter of said spindle means for passing said current from said contact member to the entire inner diameter of a computer memory disc juxtaposed thereto.

3. The apparatus of claim 2, said busbar means being a cylindrical member comprising:

an inner layer of conductive material, said inner layer being in electrical contact with said contact members, said inner layer of conductive material arranged so as to be in contact with and aligned with the inner diameter of a computer memory disc juxtaposed thereto; and an outer layer of insulative material extending about said inner layer.

4. The apparatus of claim 3, said outer layer having an O-ring engaged about one end of said cylindrical member, said O-ring arranged so as to form a liquid-tight seal between a computer memory disc placed thereagainst and said busbar means.

5. The apparatus of claim 1, further comprising:

a plating bath contained by said plating container means, said plating bath having a depth sufficient for complete submerging of a computer memory disc when fixed to said spindle means.

6. The apparatus of claim 1, said stationary anode means mounted to the bottom of said plating container means such that said stationary anode means is aligned in plane parallel with the surface of a computer memory disc mounted to said spindle means.

7. The apparatus of claim 1, said stationary anode means mounted to the bottom of said plating container means such that said anode member is aligned in plane parallel with an adjacent anode member.

8. The apparatus of claim 1, said busbar member being electrically conductive and insulated from said plating bath, said electrical transmission means being electrically connected to said busbar member.

9. The apparatus of claim 1, said anode member comprised of platinum.

10. The apparatus of claim 1, said electrical transmission means comprising:

a plurality of current regulators connected to said stationary anode means, each of said stationary anode means having a separate current regulator, said current regulator for controlling the magnitude of current flow to said stationary anode means.

11. The apparatus of claim 1, said plating container means comprising an insulative separator fastened to and extending from the bottom of said plating container means, said insulative separator positioned between said stationary anode means and having an upper curved edge.

12. The apparatus of claim 1, said plating container means further comprising:

air agitation means positioned in said plating container means and between said stationary anode means, said air agitation means for passing gas parallel to and between said stationary anode means.

13. The apparatus of claim 1, said plating container means further comprising:

flow control means integrated into said plating container means for directing the flow of said liquid plating bath in a direction parallel to and between the surfaces of said stationary anode means.

14. The apparatus of claim 1, said busbar member in continuous electrical contact with the entire length of said lower curved edge of said anode member.

15. The apparatus of claim 1, said upper curved edge and said lower curved edge of said anode member being concentric with the longitudinal axis of said spindle means.

16. The apparatus of claim 1, said anode member having a shape being an exact subdivision pie-cut of a disc.

17. A method of electrolytically plating a plurality of computer memory discs comprising the steps of:

fastening a plurality of computer memory discs to a plurality of receiving sections of a spindle, said computer memory discs being fastened such that said computer memory discs extend radially from said spindle, said computer memory discs fastened such that the inner diameter of said computer memory discs generally continuously contact said spindle;

submerging said plurality of computer memory discs entirely into an electrolytic plating bath;

rotating said spindle and said computer memory discs in said plating bath; and transmitting an electrical current through said spindle to said discs, said electrical current passing from each of said discs to stationary anodes located on opposite sides of each of said discs in said bath, said discs being rotated while said current is being transmitted.

18. The method of claim 17, said step of fastening comprising:

attaching a first cylindrical space about the outer diameter of said spindle, said first cylindrical spacer including an electrically conductive layer for transmitting electrical current;

sliding the central aperture of each of said plurality of computer memory discs over the outer diameter of said spindle, one side of each of said discs abutting an end of said first cylindrical spacer; and fastening a second cylindrical spacer about the outer diameter of said spindle, said second cylindrical space having an electrically conductive layer for transmitting electrical current, one end of said second cylindrical spacer abutting the other side of each of said discs.

19. The apparatus of claim 18, further comprising the step of:

attaching an end cap about said spindle, said end cap having an end abutting said second cylindrical spacer, said end cap for fixing the positions of said first cylindrical spacer, each of said discs, and said second cylindrical spacer relative to the longitudinal axis of said spindle; and tightening said end cap such that electrical contact is established between said first cylindrical spacer each of said discs and said second cylindrical spacer.

20. The method of claim 17, further comprising the steps of:

removing said electrical current from said computer memory discs;

removing said discs and said spindle from said electrolytic plating bath; and removing said discs from said spindle.

21. The method of claim 17, further comprising the step of:

changing the rotation from one speed to another speed of said spindle and said computer memory discs while said electrical current is transmitted through said spindle to said discs.

* * * * *